US005378295A

United States Patent [19]

Yamashita et al.

[11] Patent Number: 5,378,295

[45] Date of Patent: Jan. 3, 1995

[54] GOLF CLUB HEAD AND A METHOD FOR PRODUCING THE SAME

[75] Inventors: Hiroyuki Yamashita; Toshiharu Hoshi; Yuma Horio; Kazuhiro Tsuchiya; Takashi Iijima, all of Shizuoka; Kikuo Nishida, Sizuoka, all of Japan

[73] Assignee: Yamaha Corporation, Japan

[21] Appl. No.: 28,274

[22] Filed: Mar. 9, 1993

[30] Foreign Application Priority Data

| | | | |
|---|---|---|---|
| Mar. 9, 1992 | [JP] | Japan | 4-85943 |
| May 15, 1992 | [JP] | Japan | 4-148851 |
| May 21, 1992 | [JP] | Japan | 4-154344 |

[51] Int. Cl.[6] ..... C21D 9/00; A63B 53/04

[52] U.S. Cl. ..... 148/654; 273/167 R; 273/167 H

[58] Field of Search ..... 273/77 R, 167 R, 167 J, 273/78, 193 R, 194 R, DIG. 7, DIG. 23, 167 H, 169; 148/654

[56] References Cited

U.S. PATENT DOCUMENTS

| | | | |
|---|---|---|---|
| 3,666,452 | 5/1972 | Korchyn | 148/654 |
| 4,115,155 | 9/1978 | Roe | 148/654 |
| 4,314,863 | 2/1982 | McCormick | 420/61 |
| 4,576,655 | 3/1986 | Josefsson | 148/654 |
| 5,089,067 | 2/1992 | Shumacher | 148/325 |
| 5,104,457 | 4/1992 | Viljoen | 273/167 R X |
| 5,154,781 | 10/1992 | Catellier | 148/542 |
| 5,167,733 | 12/1992 | Hsieh | 148/522 |

FOREIGN PATENT DOCUMENTS

| | | | |
|---|---|---|---|
| 0029329 | 3/1980 | Japan | 273/167 R |
| 0222172 | 12/1984 | Japan | 273/167 R |
| 0013073 | 1/1985 | Japan | 273/167 A |
| 3226378 | 9/1988 | Japan | 273/167 R |
| 1259877 | 10/1989 | Japan | 273/167 R |
| 1259878 | 10/1989 | Japan | 273/167 R |
| 2149279 | 6/1990 | Japan | 273/167 R |
| 2168974 | 6/1990 | Japan | 273/167 R |

*Primary Examiner*—Sebastiano Passaniti

*Attorney, Agent, or Firm*—Ostrolenk, Faber, Gerb & Soffen

[57] ABSTRACT

In production of a shell-type golf club head made up of several different pieces, an iron-type material of a specified chemical composition and carbon equivalent is subjected to a combination of annealing before shaping with quenching after shaping. Exclusion of the conventional casting process in production much improves mechanical characteristics of the product and increase mechanical strength enables formation of a large size golf club head with an enlarged sweet spot. Limited and locally specified disposition of weld lines assures highly accurate lie and loft angles with reduced welding strain.

8 Claims, 9 Drawing Sheets

GOLF CLUB HEAD AND A METHOD FOR PRODUCING THE SAME

BACKGROUND OF THE INVENTION

The present invention relates to a golf club head and a method for producing the same, and more particularly relates to improvements in mechanical and dimensional characteristics of a golf club head made of a metallic material such as high-tensile steel.

A metallic golf club head is in general produced conventionally from a metallic material such as stainless steel alloys, aluminum alloys, titanium alloys and beryllium alloys by means of precision casting. Due to employment of a casting process in production, casting defects and local concentration of components are unavoidably present in the product. They concur to degrade the mechanical characteristics of the product such as proof stress and tensile strength of the product. Such disadvantages are further amplified by relatively coarse nature of crystal gains special to the precision casting.

Because of the low level of the mechanical characteristics, it is difficult to form a thin shell construction and, as a consequence, it is difficult to enlarge the entire size of the product without increase in weight. As well known in the art, a small golf club head is very poor in its sweet spot, which results in unstable flight of balls strikes by the golf club head.

In an attempt to avoid such disadvantages derived from the casting process, it is proposed as an alternative to unit together by welding a number of sectional, pieces which are produced by processes other than precision casting. In this case, the sectional pieces are produced, for example, by forging or pressing.

One example of such an assembly type golf club head is disclosed in Japanese Utility Model Publication (JUMP) Sho. 61-33971, A golf club head of this earlier proposal is made up of two sectional pieces, i.e. a face section provided with a front hosel half and a rear section provided with a rear hosel half. When the face and the rear sections are united together, the hosel halves form a hosel to hold a shaft. In the case of this example, the hosel halves are united together by welding which tends to generate strain in the body of the golf club head. Generation of such strain during production may disorder the originally designed lie and loft angles of the golf club head.

Another example of the assembly type golf club head is disclosed in Japanese Patent Laid-open (JPLO) Sho. 59-20182. A golf club head of this earlier proposal is made up of four sectional pieces, i.e. a face section, a sole section, a crown section and a hosel section. Since the hosel section is separate from other sections, welding has to be applied all around the hosel section during assembly. Such overall welding on the hosel section inevitably generates great strain in the body of the golf club head which seriously degrades accuracies of the lie and loft angles, Presence of a welded joint between the hosel and face sections lowers mechanical strength of the entire construction. Stress concentration on many weld lines during use may incur accidental breakage of the golf club head, The other example of the assembly type golf club head is disclosed in JUMP Sho. 61-33970. A golf club head of this earlier proposal is made up off four sectional pieces, i.e. a face section, a sole section provided with a rear hosel half, a crown section provided with a front hosel half and a shaft insert section. An inner reinforcement is attached to the sole section. Presence of many weld lines develops high degree of strain in production and lowers resistance against mechanical shocks during use of the product. Intricate operations are needed for uniting the sectional pieces together in production. A like prior art example is found in JUMP Sho. 61-33972 too.

SUMMARY OF THE INVENTION

It is thus the primary object of the present invention to produce a golf club head of high degree of mechanical characteristics.

It is another object of the present invention to produce a golf club head having an enlarged sweet spot.

It is the other object of the present invention to produce a golf club head with lie and loft angles of high accuracy.

In accordance with the first aspect of the present invention, a golf club head is made of a steel plate having an yield stress of 1,000 MPa or higher.

In accordance with the second aspect of the present invention, an iron-type material of a specified chemical composition and a carbon equivalent from 0.80 to 1.30 is first annealed at a temperature from 650° to 750° C. prior to shaping into prescribed configurations and a shaped product is then quenched via air cooling. The chemical composition contains 0.05 to 0.35% by weight of C, 0.40% by weight or less of Si, 2.20% by weight or less of Mn, 4.00% by weight or less of Ni, 3.0% by weight or less of Cr, 1.00% by weight or less of Mo, 0.10% by weight or less of Nb, 0.10% by weight or less of Al, 0.02% by weight or less of P, 0.01% by weight or less of S, 1.50% by weight or less of Cu, 0.001% by weight or less of B, 0.01% by weight or less of N and Fe with indispensable impurities in balance.

In accordance with the third aspect of the present invention, a golf club head is made up of a face piece and a rear piece coupled in one body to each other. The face piece includes a face section and a rear section extending from the face section and coupled to the rear piece.

In accordance with the fourth aspect of the present invention, a metal plate of a prescribed profile is subjected to forging after rough shaping to form a face piece having a face section and a rear section extending from the face section and the face piece is locally rolled to form a hosel section which extends sideways from the face and rear sections.

DESCRIPTION OF THE PREFERRED EMBODIMENTS

Figure 1:
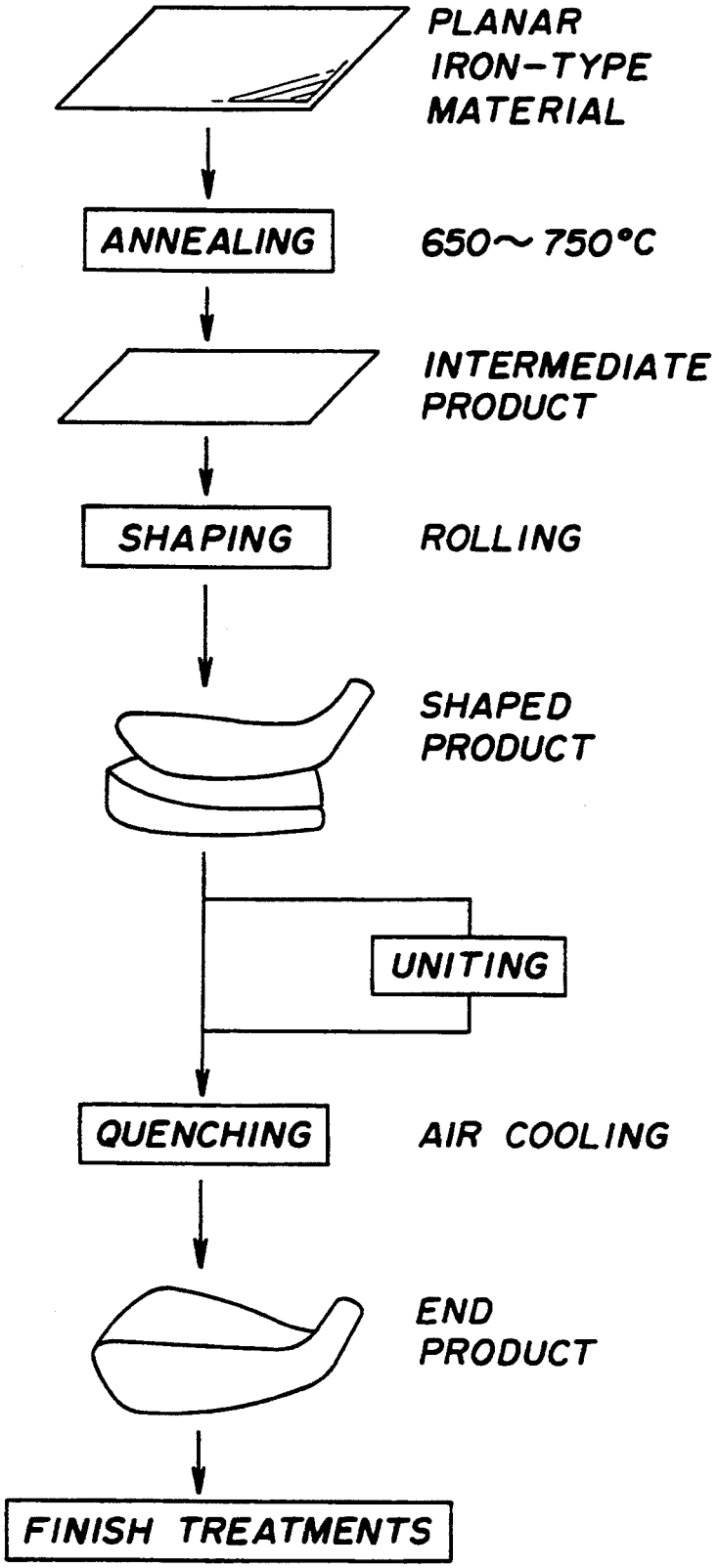
FIG. 1 is a flow-chart of one embodiment of the method for producing the golf club head in accordance with the present invention.

In accordance with one aspect of the present invention, an iron-type material of the above-specified chemical composition has a carbon equivalent from 0.80 to 1.30. This range of carbon equivalent is suited for later-staged quenching via air cooling. When the quenching is carried out via wafer cooling, however, the carbon equivalent should be in a range from 0.05 to 1.30 as later described in more detail.

The iron-type material of such chemical characteristics is first subjected to annealing at a temperature from 650° to 750° C. to obtain an intermediate product of an yield stress of 400 MPa or lower and an elongation of 20% or higher. The intermediate product is then shaped into prescribed configurations to form a shaped product. The shaped product is finally subjected to quenching to obtain an end product of an yield stress of 1,000 MPa or higher and a tensile strength of 1,200 MPa or higher.

When quenching is carried out via air cooling, the carbon equivalent (Ceq) of the iron-type material should suffice the following relationship;

$$0.80 \leqq Ceq \leqq 1.30 \quad (1)$$

When quenching is carried out via water cooling, the carbon equivalent (Ceq) of the iron-type material should suffice the following relationship:

$$0.05 \leqq Ceq \leqq 1.30 \quad (2)$$

In either case, however, the carbon equivalent (Ceq) of the iron-type material should further suffice the following relationship;

$$Ceq = (\%\ C) + (\%\ Mn)/6 + (\%\ Si)/24 + (\%\ Ni)/40 + (\%\ Cr)/5 + (\%\ Mo)/4 + (\%\ V)/14$$

wherein description in each parenthesis indicates % by weight content of each component.

The shaped product after annealing should preferably have a an yield stress of 400 MPa or lower and an elongation of 20% or higher, when the yield stress reaches 500 MPa after annealing, no good shaping carried out in the subsequent step. Whereas, a yield point from 200 to 300 MPa assures beautiful shaping. When the elongation falls down to 10% after annealing, no good shaping can be expected in the following step. An elongation from 30 to 40enables smooth shaping.

Process conditions In the quenching should be adjusted so that the end product has a yield stress of 1,000 MPa or higher. For this confirmation, golf club head samples made of steel plates of various mechanical strengths were subjected to striking tests. As a result of the tests, it was confirmed that no depression was developed when the after-quenching yield stress exceeds 1,000 MPa whereas depressions was produced for yield stresses below 800 MPa.

Steps employed in production of the above-described golf club head are shown in sequence in FIG. 1. In the first place, a planar iron-type material of the specified chemical composition and of the specified carbon equivalent is prepared by, for example, cool rolling, forging or solid solution process. The planar iron-type material is then subjected to annealing at a temperature from 650° to 750° C. In order to soften the material into an intermediate product suited for the subsequent shaping. When the annealing temperature is lower than 650° C., the intermediate product is too hard to be subjected good shaping. Any annealing temperature would cause undesirable precipitation of coarse carbides which poses malign influence on the final quenching step.

The chemical composition special to the iron-type material used for the present invention is fixed for the following reasons.

The content of C (carbon) should be in a range from 0.05 to 0.35% by weight. Addition of C raises the mechanical strength of the iron-type material. When the content of C falls short of 0.05%, the strength of the end product is unsuited for use as a golf club head. Whereas, when the content of C exceeds 0.35%, the material is poor in toughness and becomes unsuited for welding.

The content of Si (silicon) should be 0.40% by weight or less. Presence of Si is effective in deoxidation. Presence of Si beyond this upper limit would make the material unsuited for welding. In addition, toughness of parts influenced by welding heat (HAZ toughness) would be degraded seriously.

The content of Mn (manganese) should be 2.20% by weight or less. Inclusion of Mn in the material improves its mechanical strength and fitness for quenching. Any content beyond the upper limit would mar fitness and HAZ toughness.

The content of Ni (nickel) should be 4.00% by weight or less. Presence of Ni enhances mechanical strength and toughness of the material. However, its fitness to welding would be lowered when the content of Ni exceeds this upper limit.

The content of Cr (chromiun) should be 3.0% by weight or less. Addition of Cr raises mechanical strength of the material and, in particular, mechanical strength of the welded parts (welding strength). Any content of Cr beyond this upper limit, however, would deteriorate fitness to welding and HAZ toughness of the material.

The content of Mo (molybdenum) should be 1.00% by weight or less. Inclusion of Mo in the material improves its mechanical strength and welding strength. Excessive content of Mo would impair its fitness to welding and HAZ toughness.

The content of Nb (niobium) should be 0.10% by weight or less. Presence of Nb in the material maintains the fine structure of austenite under the room temperature condition. No increased effect can be expected for any content beyond this upper limit.

The content of Al (aluminium) should be 0.10% by weight or less. Al is effective in deoxidation and AlN presence in the material maintains the fine structure of austenite under the room temperature condition. No increased effect can be expected for any content beyond this upper limit.

The content of P (phosphorus) should be 0.02% by weight or less. P is one of the indispensable impurities but its content beyond the upper limit would degrade the low temperature toughness of the material.

The content off S (sulfur) should be 0.01% by weight or less. Like P, S is one off the indispensable impurities and its content beyond the upper limit would also degrade the low temperature toughness of the material.

The content of Cu (copper) should be 1.50% by weight or less. Presence of Cu in the material increases its mechanical strength. Excessive content of Cu beyond the upper limit, however, results in poor hot workability.

The content of B (boron) should be 0.001% by weight or less. Presence of B in the material increases its hardenability. When the content of B exceeds the upper limit, toughness of the material is much lowered.

The content of N (nitrogen) should be 0.01% by weight or less. N is one of the indispensable impurities but its content beyond the upper limit would degrade toughness of the material.

The carbon equivalent (Ceq) of the material should be 0.80 or higher for quenching via air cooling and 0.05 or higher for quenching via water cooling. As in the case of C addition, setting of the lower limit for the carbon equivalent (Ceq) assures high mechanical strength of the iron-type material. For effective suppression of quenching strain, it is preferable to carry out the quenching via air cooling. In order to obtain sufficient mechanical strength even with relatively low speed cooling by air, higher degree of carbon equivalent (Ceq) is necessary in the case of quenching via air cooling. Any carbon equivalent (Ceq) beyond 1.30 would deteriorate HAZ toughness of the material.

Next, the intermediate product is shaped, for example by pressing, into a prescribed configuration to obtain a shaped product. Most generally, each shaped product is given in the form of a piece of a complete golf club head. However, the shaped product may take the form of a complete golf club head. When given in the form of a piece, pieces are united together via, for example, MAG welding to form a complete golf club head. Proper cutting may be applied to before or after uniting. Finally, the shaped product is subjected to quenching to obtain an end product.

Figure 2:
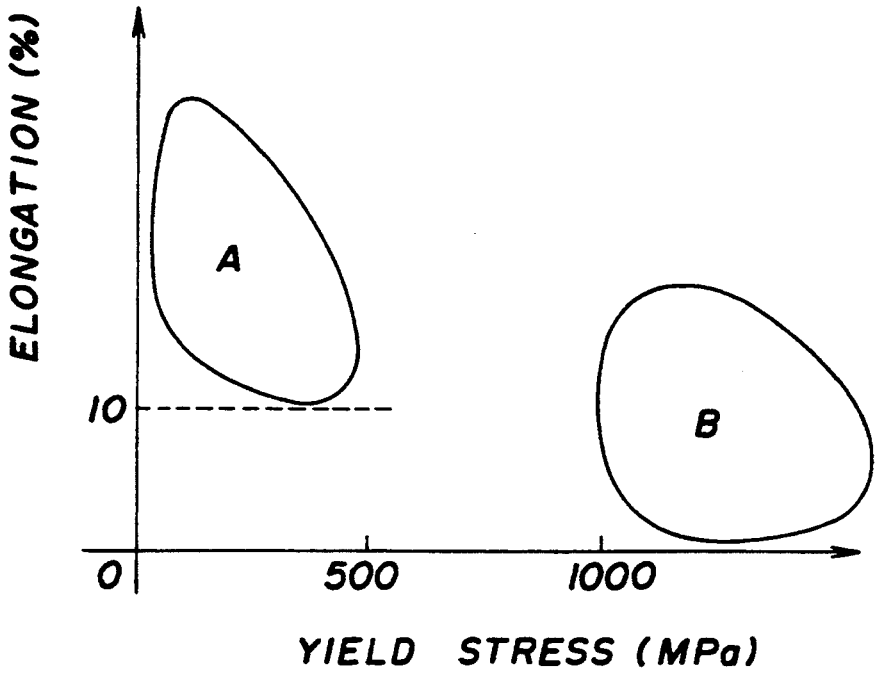
FIG. 2 is a graph for showing the mechanical characteristics of the golf club head produced by the method in accordance with the present invention.

The mechanical characteristics of the end product is shown in FIG. 2 in which an area A is for the intermediate product before shaping and an area B is for the end product after quenching. As clearly shown, the intermediate product before shaping has a yield stress lower than 500 MPa and an elongation higher than 10%. The elongation falls after the quenching but the yield stress rises above 1,000 MPa.

After the quenching, the end product is subjected to proper finish treatments such as polishing and surface treatment to obtain a golf club head in accordance with the present invention.

The combination of shaping after initial annealing with final quenching enables production of a golf club head with high degree of mechanical characteristics. Thank to such improved mechanical characteristics, the shell of a golf club head can be made appreciably thinner and such a thin but strong shell construction allows production of a large size golf club head which provides and enlarged sweet spot. As the chemical composition of the iron-type material is designed to minimize later-staged generation of welding strains, the lie and loft angles of the end product are as accurate as originally designed.

In accordance with the other aspect of the present invention, a golf club head is made up of a face piece and a rear piece coupled in one body to each other. The face piece includes a face section and a rear section extending from the face section and coupled to the rear piece.

In one preferred embodiment, the face piece is locally rolled into a tubular configuration to form a hosel section which extends sideways from the face and rear sections.

In production, a metal plate of a prescribed profile is subjected to forging after rough shaping to form a face piece having a face section and a rear section and the face piece is locally rolled as described above to form a hosel section.

Figure 3:
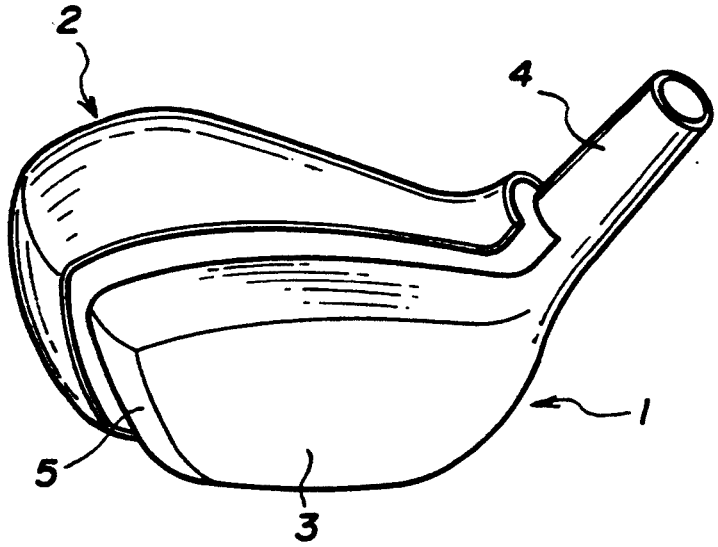
FIG. 3 is a perspective view of one embodiment of the golf club head in accordance with the present invention.

A golf club head in accordance with the other aspect of the present invention is shown in FIG. 3. The illustrated golf club head includes a face piece 1 and a rear piece 2 coupled to the face piece 1. The face piece 1 includes, in one body to each other, a face section 3 a rear section 5 extending rearwards from the face section S, and a hosel section 4 for holding a shaft. The hosel section 4 extends sideways from the face and rear sections and has a tubular configuration which is rolled and united together at mating ends along one weld line. The weld line runs in the longitudinal direction of the hosel section 4 but does not appear in the illustration.

In the case of this embodiment, the face and rear pieces are united together along one weld line in a plane substantially parallel to the face of the golf club head. Thus, at striking balls, only compression acts on the welded part and no bending stress acts. As a consequence, breakages at the welded part are greatly reduces.

Different from the prior art construction in which a hosel section is welded to the main body of a golf club head, the hosel section formed in one body with the face and rear section better withstands external shocks, thereby reducing breakages at the hosel section. Since the hosel section requires only one weld line in its longitudinal direction, possibility of welding strain is much lowered to provide accurate lie and loft angles. Degradation in quality of the iron-type material by welding is also well obviated. Since the face piece 1 is welded to the rear piece 2 along the rear end of its rear section 5, there is no welded part near the face to simplify polishing after welding.

Figure 4A:
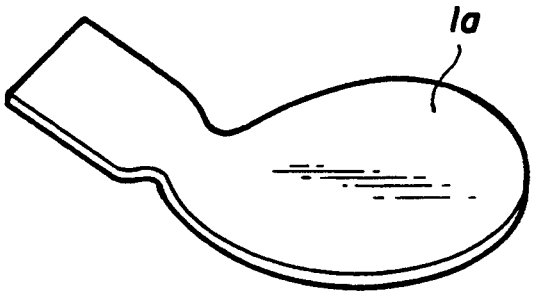
FIGS. 4A to 4C are perspective views of operation steps in formation of a face piece used for production of the golf club head in accordance with the present invention.
Figure 4B:
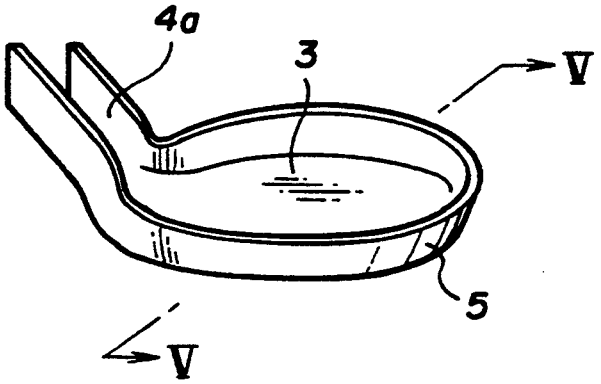
Figure 4C:
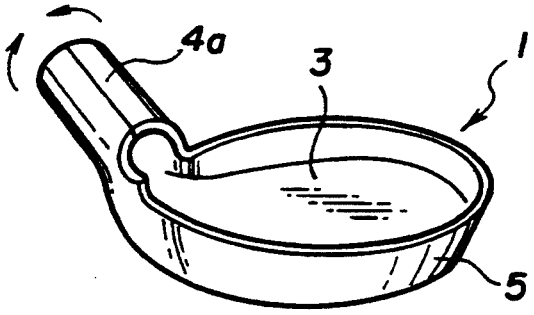

Operation steps in production of the face piece 1 is exemplified in FIGS. 4A to 4C. First, a metal plate la such as shown in FIG. 4A is prepared. This metal plate is made of an iron-type material which preferably has the chemical composition such as specified in accordance with the above-described second aspect of the present invention. More specifically, the iron-type material preferably contains 0.05 to 0.35% by weight of C (carbon), 0.40% by weight or less of Si (silicon), 2.2% by weight or less of Mn (manganese), 4.00% by weight or less of Ni (nickel), 3.0% by weight or less of Cr (chromium), 1.00% by weight or less of Mo (molybdenum), 0.10% by weight or less of Nb (niobium), 0.10% by weight or less of Al (aluminium), 0.02% by weight or less of P (phosphorus), 0.01% by weight or less of S (sulfur), 1.50% by weight or less of Cu (copper), 0.001% by weight or less of B (boron), 0.01% by weight or less of N (nitrogen) and Fe with indispensable impurities in balance.

Figure 5:
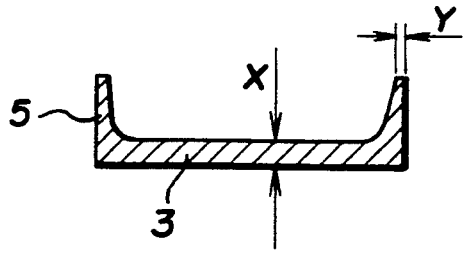
FIG. 5 is a section taken along a line V—V in FIG. 4B.

Next, after rough shaping, the metal plate 1*a* is subjected to cool forging so that the plate assumes a configuration shown in FIG. 4B. At this station of production, the face and rear sections 3, 5 assume a pan like configuration such as shown in FIG. 5 and the hosel section 4*a* has a U-shaped transverse cross sectional profile. In one actual example, the thickness (X) of the face section 3 is set to 3.2 mm and the thickness (Y) of the rear section 5 at the distal end is set to 0.8 min.

Figure 6:
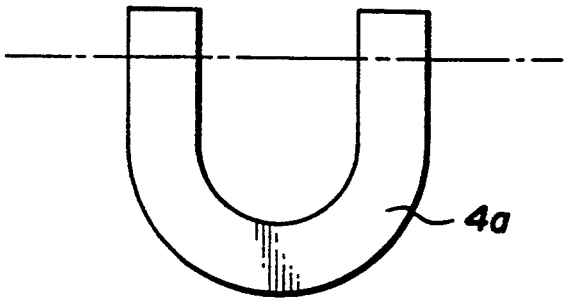
FIG. 6 is an end view at end trimming of the hosel section of the face piece showing in FIGS. 4A to 4C.
Figure 7:
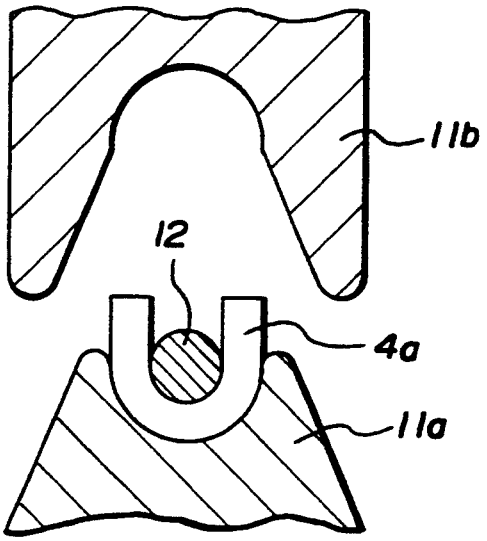
FIG. 7 is a sectional view at rolling of the hosel section.

After the forging, the shaped metallic plate 1*a* is subjected to complete rolling of the U-shaped hosel section 4*a* as shown with arrows in FIG. 4*c*. For this rolling, distal ends of two branches of the U-shaped hosel section 4*a* are trimmed via use of fine plasma or optical laser as shown in FIG. 6. For this rolling, a circular rod 12 is placed in the center of the U shape as shown in FIG. 7, the hosel section 4*a* is placed on a lower die 11*a* and on upper die 11b 1s set onto the lower die 11*a* in a manner to strongly clamp the hosel section 4*a* which is then rolled into a tubular configuration. The face piece 1 is now complete.

Figure 8A:
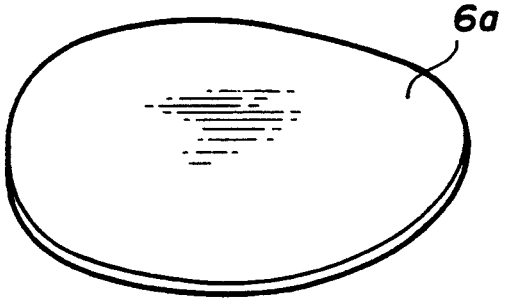
FIGS. 8A to 8C are perspective views of operation steps in formation of a rear piece used for production of the golf club head in accordance with the present invention.
Figure 8B:
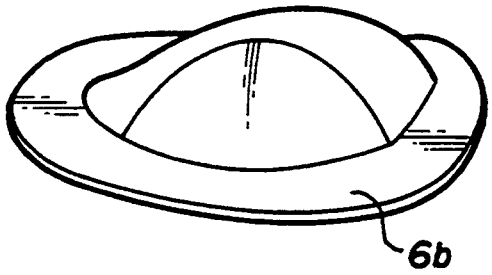
Figure 8C:
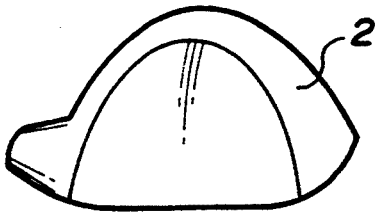
Figure 9:
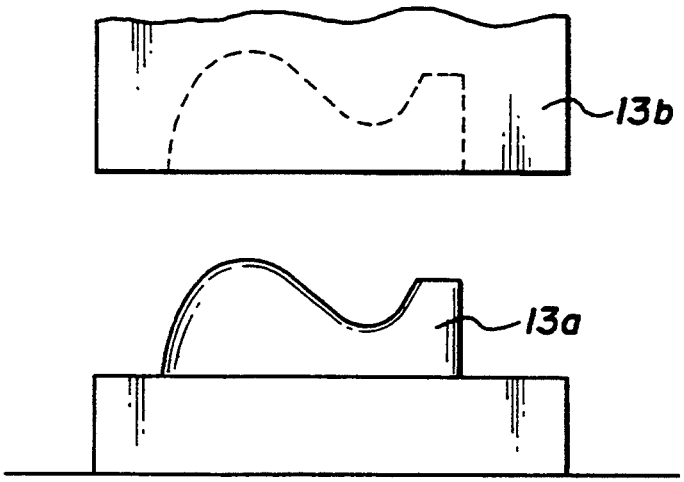
FIG. 9 is a side view of dies used for formation of the rear piece shown in FIGS. 8A to, 8C.

Next, the rear piece 2 is formed in a manner, for example, shown in FIGS. 8A to 8C. First, a planar metal plate 6*a* of a prescribe profile such as shown in FIG. 8A is prepared from an iron-type material having the above-described chemical composition. The metal plate 6*a* is then roughly shaped to obtain an intermediate product 6*b* such as shown in FIG. 8B. Next, the intermediate product 6*b* is subjected to deep squeezing using a pair of dies 13*a* and 13*b* such as shown in FIG. 9 to form a rear piece 2 such as shown in FIG. 8C. In consideration of this deep squeezing, the metal plate 6*a* should preferably made of an iron-type material having an yield stress of 500 MPa or lower and an elongation of 20% or higher.

After formation of the face piece 1 and the rear is complete, the rear piece 2 is united to the face piece 1 by means of welding. Concurrently, the mating ends of the hosel section 4*a* of the face piece are united together by means of welding. Metal Active Gas (MAG) is preferably employed for this uniting. The inner diameter of the hosel section 4*a* is then enlarged to, for example, 8.7 mm via drilling. The united product is then subjected to quenching to obtain a golf club head such as shown in FIG. 3. Process conditions in the quenching are adjusted so that the obtained golf club head has an yield stress of 1,000 MPa or higher. Proper finish treatments then follow as shown in FIG. 1.

Figure 10:
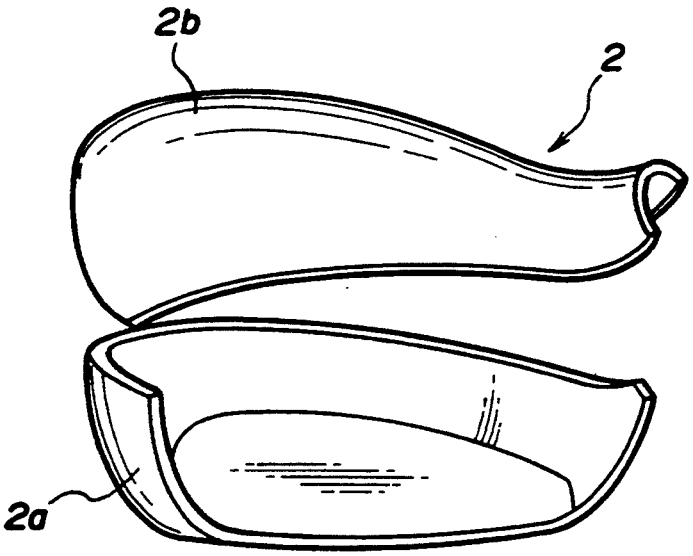
FIG. 10 is a perspective view of another embodiment of the rear piece usable for the golf club head shown in FIG. 3.

In the case of the embodiment of the method shown in FIGS. 8A to 8C, the rear piece 2 is made of a single metal plate. However, two metal plates may be used so as to produce a rear piece 2 shown in FIG. 10, in which the rear piece 2 is made up of two sections 2*a* and 2*b*; More specifically, the rear piece 2 is made up of a sole section 2*a* and a crown section 2*b*.

The metal plate may be made of a Ti-type material as long as its allows cool forging.

In accordance with the third aspect of the present invention, the hosel section can well withstand external shocks thanks to its monolithic connection to the face and rear sections of the face piece, Formation of only one weld line on the hosel section of the face piece minimizes undesirable development of weld strains, thereby providing highly accurate lie and loft angles. Exclusion of the conventionally employed precision casting allows formation of a thin-shell, large sized golf club head which provides an enlarged sweet spot.

In another embodiment of the golf club head made up of face and rear pieces, the face piece Is also made up of a face section and a rear section and the rear section is adjusted in thickness distribution. More specifically, the rear section of the face piece is thicker on the face section side and thinner on the rear piece side. Additionally, the thickness of the rear piece side end of the rear section is in a range from 1 to 1.3 times of that of the rear piece.

Preferably, the rear piece is made up of a sole section and a crown section united to each other. The sole section is thicker than the crown section but thinner than the face section of the face piece.

It is generally required for the face section of a golf club head to have a thickness of 2.5 mm or higher in order to well withstand external shocks at striking balls. Whereas, other sections of a golf club head are generally required to have a thickness in a range from 0.5 to 1.5 mm in order to a thin shell construction which is necessary for a large sweet spot without increase in weight. When the rear section of the face piece is designed as thick as the face section, a significant gap in thickness inevitably exists between the rear section of the face piece and the rear piece. When the thick rear section is united to the thin rear piece by welding, significant difference in thermal capacity between the two members tends to lower mechanical strength at the welded parts and, in the worst cases, dissembles welding itself.

In order to cover this disadvantage, the thickness of the rear piece side end of the rear section should be designed so as to be in a range from 1 to 1.3 time of that of the rear piece as described above. When the thickness of the rear section at the joint to the rear piece exceeds this upper limit, the mechanical strength of the welded joint is seriously degraded and, in the worst case, welding itself cannot be carried out smoothly.

In accordance with preference by a user, a balance weight may be optionally attached to the sole section of the rear piece for adjustment in position of the center of gravity. In order to increase the depth of the center of gravity, it is preferable to locate the balance weight as much in the rear zone of a golf club head as possible. However, the limited interior space of the golf club head does not allow free disposition of the balance weight within the head main body. Due to such limitation, no free adjustment in position of the center of gravity is allowed for the user depending on the extent of his or her preference.

In order to cover this disadvantage, it is also proposed in accordance with the present invention to form the rear piece from a crown section and a sole section and make the sole section thicker than the crown section but thinner than the face section of the face piece.

Figure 11:
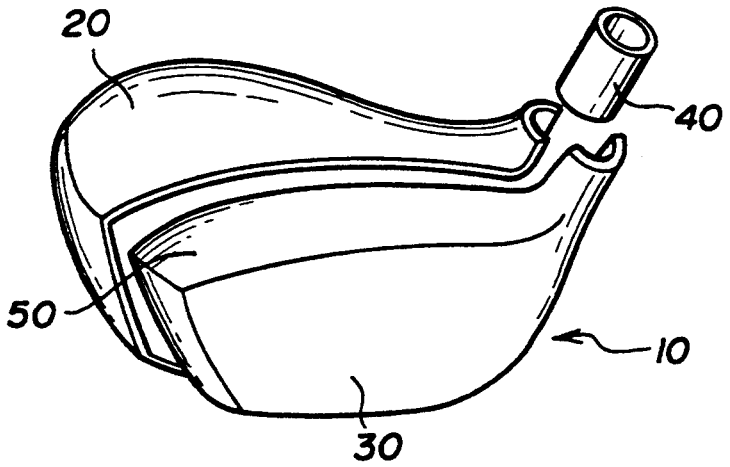
FIG. 11 is a perspective view of another embodiment of the golf club head in accordance with the present invention.

A golf club head of this embodiment is shown in FIG. 11 in which the golf club head is made up of a face piece 10, a rear piece 20 and a hosel piece 40 coupled to each other via, for example, welding. The face piece 10 includes a face section 30 and a rear section 50 extending rearwards from the face section.

Figure 12:
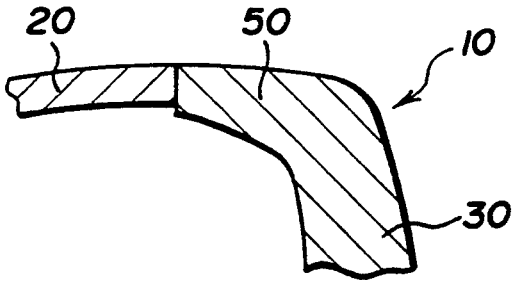
FIG. 12 is a cross sectional view of the golf club head near the joint between the face section of the face piece and the rear piece.

As shown in FIG. 12, the thickness of the rear section 50 decreases continuously from an end mating of the face section 30 to an end mating of the rear piece 20. At the mating end, the thickness of the rear section 50 should be in a range from 1 to 1.3 times of the thickness of the rear piece 20.

Thanks to the wedge-shaped cross sectional, the rear section 50 of the face piece 10 has a high mechanical strength. Thanks to substantial absence of difference in thickness at the joint, the rear piece 20 can be welded to the rear section 50 of the face piece 10 free of troubles. At striking balls, compression and bending stress act on the joint between the face section 30 and the rear section 50 due to bending of the former. The monolithic construction of the joint in accordance with the present invention well endures such action without breakage. Only compression acts on the joint between the rear section 50 and the rear piece 20 with no generation of bending stress, thereby well avoiding breakages at this joint. In addition, no presence of weld lines at the border of the face section 30, finish polishing at angled corners of the face section 30 can be carried out quite easily.

Production of the golf club head is carried out in a manner substantially same as those shown in FIGS. 4A to 4C and 8A to 8C with an exception that the hosel piece 40 is separately shaped and united to the main body made up of the face piece 10 and the rear piece 20.

In formation of the face piece, a metal plate of, for example, 3.2 mm thickness is first made of Ti alloys or iron-type metals. After the cold forging, the face section has a thickness of, for example, 3.2 mm and the rear section has a thickness of 0.8 mm. In formation of the rear piece, a metal plate of, for example, 1.0 mm thickness is used.

EXAMPLES

Example 1.

An iron-type metal plate was made of a material containing 0.22% by weight of C, 0.26% by weight of Si, 1.95% by weight of Mn, 0.16% by weight of P, 0.001% by weight of S, 0.06% by weight of Ni, 2.65% by weight Cr, 0.46% by weight Mo, 0.034% by weight of Nb, 0.035% by weight of Al and Fe in balance. The carbon equivalent of the material was adjusted to 1.20.

The material of this chemical composition was subjected to annealing at 710° for 10 Hr in a N2 gas environment. An intermediate product thus obtained had an yield stress of 294 MPa, a tensile strength of 539 MPa and an-elongation of 31%.

After shaping into a prescribed configuration, a shaped product was subjected to quenching at 910° C. for 10 min in a N2 gas environment. Air cooling followed at 300° C. for 15 min in a N2 gas environment. An end product exhibited an yield stress of 1,225 MPa, a tensile strength of 1,519 MPa and an elongation of 10%. When the mechanical characteristics of the obtained golf club head is compared with those of the above-described starting material, it is clear that employment of the present invention assures significant improvement in mechanical characteristics.

Example 2

An iron-type metal plate was made of a material containing 0.33% by weight of C, 0.013% by weight of Si, 0.14% by weight of Mn, 0.003% by weight of P, 0.0018% by weight of S, 0.46% by weight of Cu, 0.70% by weight of Ni, 0.02% by weight of Cr, 0.019% by weight of Al, 0.0043% by weight of N, 0.0007% by weight of B and Fe in balance. The carbon equivalent of the material was adjusted to 0.38.

The material of this chemical composition was subjected to annealing at 600° C. for 40 Hr in a N2 gas environment. An intermediate product thus obtained had an yield stress of 235 MPa, a tensile strength of 402 MPa and an elongation of 38%.

After shaping into a prescribed configuration, a shaped product was subjected to quenching at 870° C. for 30 min in a N2 gas environment. Cooling was carried out with water. An end product exhibited an yield stress of 1,343 MPa, a tensile strength of 1,793 MPa and an elongation of 5%. When compared with the result in Example 1, it is learned that better improvement in mechanical characteristics was attained.

Example 3

A golf club head of the construction shown in FIG. 3 was produced and was labeled as "Sample 1".

Figure 13:
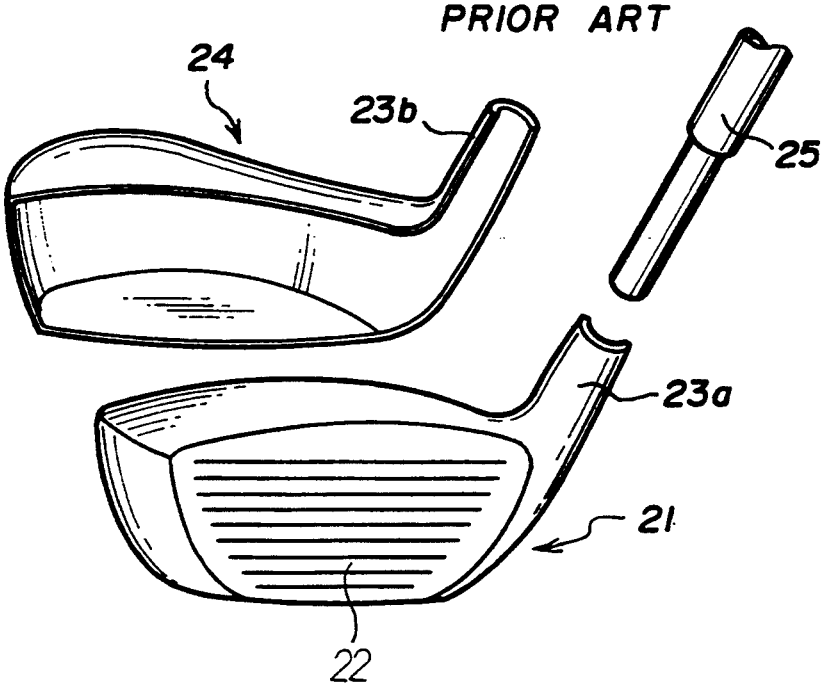
FIG. 13 PRIOR ART
FIG. 13 is a perspective view of one example of the conventional golf club head.

For comparison purposes, a golf club head was produced in accordance with the conventional art disclosed in Japanese Utility Model Publication (JUMP) Sho. 61-33971. This golf club head was labeled as "Comparative sample 1". As shown in FIG. 13, this golf club head is made up of a face piece 21 and a rear piece 24 coupled to the face piece via welding. The face piece 21 includes a face section 22 and a front hosel section **23*a* which is adapted to hold a shaft 25 in cooperation with a rear hosel section 23*b* on the rear piece 24**.

Figure 14A:
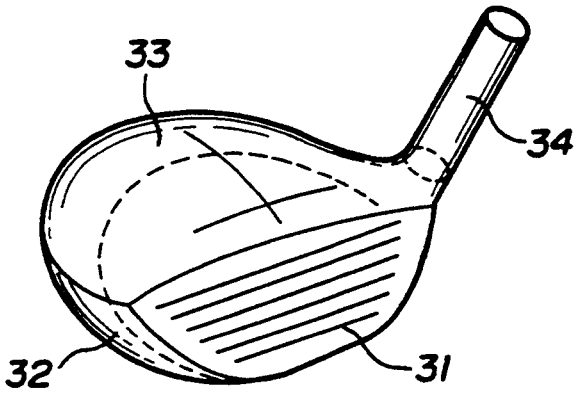
FIG. 14A PRIOR ART
FIG. 14A is a perspective view of another example of the conventional golf club head, in an assembled state.
Figure 14B:
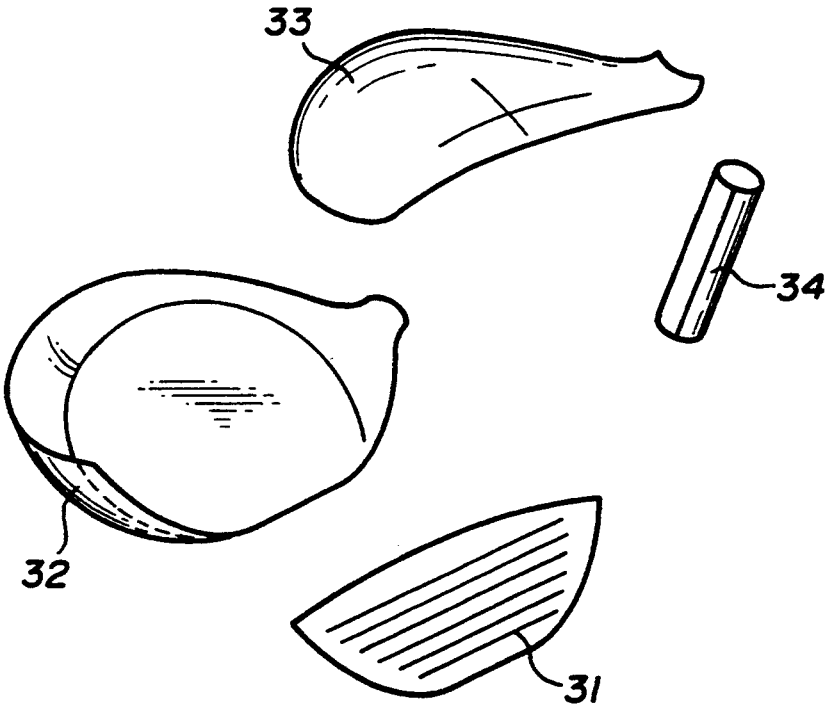
FIG. 14B PRIOR ART
FIG. 14B is a perspective view of the conventional golf club head in a disassembled state.

For comparison purposes, a further golf club head was produced in accordance with the conventional art disclosed in Japanese Patent Laid-open (JPLO) Sho. 59-20182. This golf club head was labeled as "Comparative sample 2. As shown in FIGS. 14A and 14B, this golf club head is made up of a face piece 31, a sole piece 32, a crown piece 33 and a hosel piece 34 which are prepared separately and united together via welding after separate preparation.

The three samples were used for striking balls at 40 m/sec head speed and the number of striking before breakage was measured in endurance tests. Accuracies of the lie and loft angles were checked too. Operation times needed for welding and subsequent polishing were; measured also. The obtained results are shown in Table 1.

TABLE 1

| | Number of striking before breakage | Lie and loft angle accuracy | Operation time for welding and polishing |
|---|---|---|---|
| Sample 1 | No cracks at 10,000 striking | ±0.2° | 1 |
| Comparative sample 1 | Cracks at 10,000 striking | ±0.5° | 1.5 |
| Comparative sample 2 | Breakage at 100 striking | ±1.0° | 2.5 |

As is clear from these test data, significant improvement in mechanical characteristics and lie and loft angle accuracies was observed in the case of the sample of the present invention. Minimized need for welding resulted in remarkable reduction in operation time.

Example 4

Change in mechanical strength by change in weld line on the hosel section was tested. In the illustration, the center axis of a hosel section 4 is taken as the geometrical center and the abscissa X is taken in a direction perpendicular to a plane including the face off the golf club head. The rightward direction on the abscissa X is regarded as a 0 degree angular position.

Figure 15A:
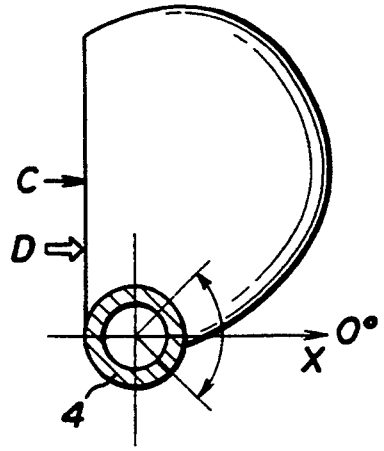
FIGS. 15A to 15C are schematic view of tests conducted in the Examples of the invention.
Figure 15B:
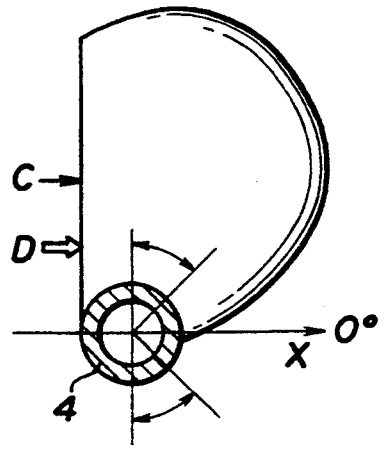
Figure 15C:
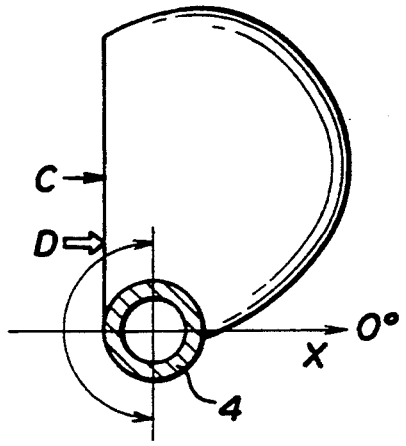

In the case of one example of the golf club head in accordance with the present invention, its weld line on the hosel section 4 was present within the angular position of ±45 degrees as shown in FIG. 15A. This golf club head was labeled as "Sample 2". In the case of another example of the golf club head in accordance with the present invention, its weld line on the hosel section 4 was present within the angular position of ±45 to ±90 degrees as shown in FIG. 15B. This golf club head was labeled as "Sample 3". In the case of one example of the conventional golf club head, its weld line on the hosel section was present within a front side angular position as shown in FIG. 15C. This golf club head was labeled as "Comparative sample 2".

The three samples were subjected ball striking at 40 m/sec head speed. In the test, a ball was striken at a position D which is distant from the face center C by 15 mm. The results of the tests are given in Table 2.

TABLE 2

| | |
|---|---|
| Sample 2 | no cracks at 20,000 striking |
| Sample 3 | no cracks at 10,000 striking |
| Comparative sample 3 | cracks developed at 5,000 striking |

It is clear from the data that choice in position of the weld line on the hosel section is very important.

We claim:

1. A method for producing a golf club head having a plurality of pieces including a face piece, a rear piece and a hosel for holding a shaft; said face piece including a face section and a rear section extending from the face section and coupled to the rear piece; said rear piece including a sole section and a crown section; said hosel extending sideways from both the face and the rear sections, the method comprising the steps of preparing an iron-type material of a chemical composition containing 0.05 to 0.35% by weight of C, 0.40% by weight or less of Si, 2.20% by weight or less of Mn, 4.00% by weight or less of Ni, 3.0% by weight or less of Cr, 1.00% by weight or less of Mo, 0.10% by weight or less of Nb, 0.10% by weight or less of Al, 0.02% by weight or less of P, 0.01% by weight or less of S, 1.50% by weight or less of Cu, 0,001% by weight or less of B, 0.01% by weight or less of N and Fe with indispensable impurities in balance, annealing said iron-type material at a temperature from 650° to 750° C. to form an intermediate product of said golf club head, shaping said intermediate product into a prescribed configuration to form a shaped product resembling at least one of the plurality of pieces of said golf club head, and quenching said shaped product to form an end product of said golf club head.

2. A method as claimed in claim 1 in which said quenching is carried out via air cooling, and said iron-type material has a carbon equivalent (Ceq) from 0.80 to 1.30.

3. A method as claim 2 in which said carbon equivalent (Ceq) further suffices the following relationship;

$$Ceq=(\%\ C)+(\%\ Mn)/6+(\%\ Si)/24+(\%\ Ni)/40+(\%\ Cr)/5+(\%\ Mo)/4+(\%\ V)/14$$

wherein description in each parentheses indicates the % by weight content of each component.

4. A method as claimed in claim 1, wherein said quenching step is carried out in such a manner that the strength of the product after quenching is at least 1,000 MPa.

5. A method as claimed in claim 1 in which said quenching is carried out via water cooling and said iron-type material has a carbon equivalent (Ceq) from 0.05 to 1.30.

6. A method as claimed in claim 5 in which said carbon equivalent (Ceq) further suffices the following relationship:

$$Ceq=(\%\ C)+(\%\ Mn)/6+(\%\ Si)/24+(\%\ Ni)/40+(\%\ Cr)/5+(\%\ Mo)/4+(\%\ V)/14$$

wherein the description in each parentheses indicates the % by weight content of each component.

7. A method as claimed in claim 5, wherein said quenching step is carried out in a manner such that the strength of said product after quenching is at least 1,000 MPa.

8. A method as claimed in claim 1 in which process conditions in said annealing are adjusted so that said intermediate product has a yield stress of 400 MPa or lower and an elongation of 20% or higher.

* * * * *